US007802680B2

(12) United States Patent
Krebs et al.

(10) Patent No.: US 7,802,680 B2
(45) Date of Patent: Sep. 28, 2010

(54) TOOL HOLDER SYSTEM WITH EXTENSION AND RETRACTION DEVICE

(75) Inventors: Kolja Krebs, Potsdam (DE); Roberto Stein, Hamburg (DE)

(73) Assignee: ZYRUS Beteiligungsgesellschaft mbH & Co. Patente I KG, Schonefeld/OT Waltersdorf (DE)

( * ) Notice: Subject to any disclaimer, the term of this patent is extended or adjusted under 35 U.S.C. 154(b) by 17 days.

(21) Appl. No.: 12/255,851

(22) Filed: Oct. 22, 2008

(65) Prior Publication Data

US 2009/0127146 A1 May 21, 2009

(30) Foreign Application Priority Data

Oct. 22, 2007 (DE) ..... 10 2007 050 712

(51) Int. Cl.
*B65D 85/28* (2006.01)

(52) U.S. Cl. ..... 206/349; 206/373; 206/477; 211/70.6; 220/23.4; 220/480

(58) Field of Classification Search ..... 206/349, 206/372–379, 477, 478, 820; 211/70.6; 220/23.4, 220/480, 735, 751
See application file for complete search history.

(56) References Cited

U.S. PATENT DOCUMENTS

| | | | | |
|---|---|---|---|---|
| 4,410,095 | A * | 10/1983 | Dembicks | 211/70.6 |
| 4,770,297 | A * | 9/1988 | Chang | 206/379 |
| 5,351,417 | A * | 10/1994 | Rubin | 34/90 |
| 5,484,057 | A * | 1/1996 | Tzu-Ching | 206/374 |
| 5,595,294 | A * | 1/1997 | McKenzie et al. | 206/349 |
| 6,047,827 | A * | 4/2000 | Huang | 206/379 |
| 7,395,984 | B2 * | 7/2008 | Szarkowski et al. | 242/384 |

* cited by examiner

*Primary Examiner*—Luan K Bui
(74) *Attorney, Agent, or Firm*—White & Case LLP

(57) ABSTRACT

According to the invention, a tool holder system having a tool holder with an extension and retraction device, in particular a reel, by means of which a cable, to which a tool can be fastened, is extendable and automatically retractive, is characterized by the fact that the tool holder can be detachably fastened by means of an attaching device.

5 Claims, 1 Drawing Sheet

TOOL HOLDER SYSTEM WITH EXTENSION AND RETRACTION DEVICE

Figure 1:
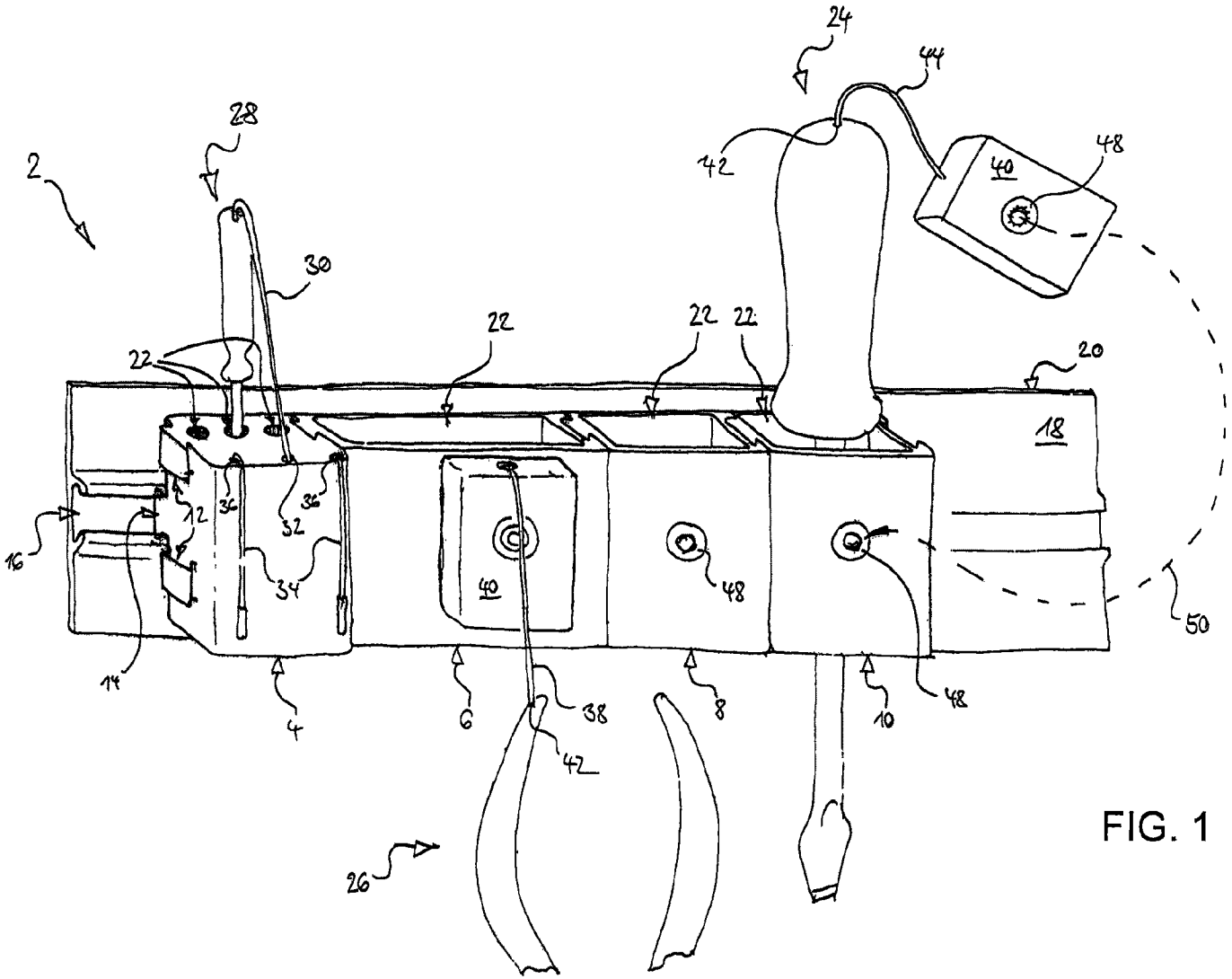

The present invention relates to a tool holder system having a tool holder with an extension and retraction device, in particular with a reel, by means of which a cable, to which a tool can be fastened, is extendable and automatically retractive.

In order to prevent something from falling to the floor, it is known to fasten, for example, pocket watches, spectacles, house or mobile telephones—but in a broader sense also many other articles—to a cable which in turn is fastened anywhere, in particular to the body of the user. For example, the watch chain has been traditionally fastened to the buttonhole, the elastic band of a ski pass usually to a zip fastener eyelet.

Furthermore, a retaining-cable system for tools has been developed whereby tools are connected on cables to a tool pocket, wherein the cable automatically winds up and becomes shorter, as it were, for example on a spring-preloaded spindle. This has the advantageous effect that the tools are secured to the cables. They then cannot fall to the floor if inadvertently let go for example—which possibly even avoids injuries, because anyone standing under a ladder would not be hit by the tool. Furthermore, the user of the tool pocket, which is preferably carried on the belt of the user, is compelled to always put his tool at the same point in the tool pocket—namely where the spindle pulls the tool. The pretension force of the cable is in this case preferably set in such a way that it only ensures that the cable does not go slack, but that the tension which is exerted on the tool by said pretension force and which the user would have to overcome has as little a negative effect as possible during use of the tool.

However, this tool pocket according to the prior art has the disadvantage that only as many tools as are provided at the tool pocket can be secured with the advantageous extension and retraction device.

Against this background, the object of the present invention is to provide a tool holder system which is more versatile in its application.

This object is achieved by a tool holder system having the features of claim 1. Preferred configurations are specified in the subclaims.

According to the invention, a tool holder system has at least one tool holder with an extension and retraction device, in particular with a reel, by means of which a cable, to which a tool can be fastened, is extendable and automatically retractive. According to the invention, the tool holder can be detachably fastened by means of an attaching device—to be precise preferably to at least one second tool holder of the tool holder system and/or to a workplace. In this way, a tool-storing location, like a tool pocket for example, which is composed of as many tool holders as the user requires, said tool holders being composed by detachably fastening them to one another, can be provided by means of the tool holder system according to the invention. Furthermore, the same or another attaching device which ensures the detachable fastening of the tool holders to one another is suitable for fastening the tool holders to a workplace: thus the tool-storing location composed according to the invention of a plurality of tool holders can be detachably, that is to say removably, fastened, for example, to a workbench and/or a lifting platform and/or a ladder by means of an attaching device according to the invention. Thus, when required, the user can then always arrange his assortment of tools securely at these points in such a way that he can reach it from a customary location and that it is returned to its tool holder by an extension and retraction device according to the invention.

However, the tool holder system according to the invention can also be detachably fastened, additionally or alternatively, to a "workplace" such as, for example, a belt and/or a trolley and/or a carrying handle and/or in a pocket and/or in a case and/or to a wall mount: fastened to a belt, it forms a belt tool pocket according to the tool pocket of the prior art—although with the advantage of matching the number of tool holders to the requirement of the user. The same applies to the fastening in a pocket or a case. Fastening to a pocket or a case is also possible according to the invention. The fastening to a carrying handle produces, as it were, a tool-carrying pocket. The capability of fastening to a wall mount results in the possibility of providing such a wall mount, for example, wherever the user of the tools would like to use his assortment of tools: for example a wall mount in the garage, a wall mount in his hobby workshop and a wall mount in the kitchen (in order to give an example from the household sector).

According to the invention, the extension and retraction device can also be detachably fastened to the tool holder. This enables a tool-storing location of the tool holder system according to the invention to be put together which has some tool holders with an extension and retraction device and some tool holders without an extension and retraction device—in order not to use the securing system, for example, for those tools in which the tensile stress of the cable especially disturbs the use of the tools. Another aspect of this detachable fastening capability between the tool holder and the extension and retraction device is the easy exchange for a spare part if, for example, the extension and retraction device should happen to be damaged.

The type and configuration of the attaching devices, by means of which the various detachable fastenings according to the invention (between the individual tool holders, between the tool holders and a "workplace" and/or between a tool holder and the associated extension and retraction device) are ensured, are not fixed: depending on the form of the tool holder (of leather, textile, plastic, metal, belt, cable, wheel and/or any other material), the attaching device can also ensure the detachable fastening capability by means of a push-in and/or screwed and/or hook-and-loop and/or snap connection.

Further features, details and advantages are described below with reference to an exemplary embodiment which is shown in the attached drawing.

The FIGURE shows, in a three-dimensional view, a tool holder system according to the invention having a plurality of tool holders on a wall mount.

The FIGURE shows a tool holder system 2 having four tool holder elements 4, 6, 8, 10 which firstly can in each case be detachably fitted to one another by means of a pair of dovetail push-in connections 12 and which secondly can be detachably pushed by means of a second dovetail push-in connection 14, which, when pushed against one another as depicted, is in alignment with one another, into a dovetail slot 16 of a wall mount 18. The wall mount 18 is plate-like overall, such that it can be fixedly adhesively bonded, with its flat rear side 20, to a wall, for example by means of double-sided adhesive tape, or can also be fixedly screwed to a wall, for example, through screw holes (not shown) in the wall mount.

The tool holders 4 to 10 each have at least one tubular pocket 22 for a tool 24, 26, 28. The tool holder 4 has three parallel receptacles 22, a small electric screwdriver 28 being inserted in the center receptacle of said parallel receptacles 22. Said electric screwdriver 28 is secured to the tool holder 4 by means of a cable 30. The cable 30 is extendable and automatically retractive from a hole 32 by means of an extension and retraction device which is integrated in the tool holder 4. Arranged on each of the other two tool receptacles 22 of the tool holder 4 is a cable 34 which is led out of a respective hole in order to fasten another tool (not shown) thereto and make it extendable and automatically retractive by means of an extension and retraction device integrated in the tool holder 4.

The receptacle 22 of the tool holder 6 has a narrow rectangular cross section and is substantially larger than the receptacles 22 of the tool openings 4. It is intended for pliers 26, which like the electric screwdriver 28 are connected to an extension and retraction device 40 via a cable 38. This extension and retraction device 40 is detachably connected to an outer side of the tool holder 6 by means of a pushbutton (not shown). Thus, if the extension and retraction device is damaged for example, the pliers 26 can be detached from the cable 38 by means of a cable coupling 42 and the extension and retraction device 40 can then be detached from the tool holder 6 and exchanged.

The tool holders 8 and 10 are of the same form and differ from the tool holder 6 only in their somewhat smaller width. Their receptacle 22 is accordingly likewise somewhat smaller in cross section and is therefore suitable, for example, for inserting a larger screwdriver 24. The latter is also connected via a cable coupling 42 to a cable 44 which, by means of an extension and retraction device 40, can be led out of a hole 46 of the extension and retraction device 40 in an extendable and automatically retractive manner. The extension and retraction device 40 can be detachably fastened to an outer side of the tool holder 10 along the dashed arrow 50 by means of a pushbutton 48. Consequently, the tool holder 8 also has such a pushbutton element 48, to which an extension and retraction device 40 can be detachably fastened.

The invention claimed is:

1. A tool holder system comprising two or more tool holders and attachment means for detachably fastening the two or more tool holders to each other, wherein each tool holder comprises an extension and retraction device comprising a reel and cable to which a tool can be fastened, and wherein the cable is extendable and automatically retractive.

2. The tool holder system according to claim 1, further comprising attachment means for detachably fastening the tool holder system to a workplace.

3. The tool holder system according to claim 2, wherein the workplace is selected from the group consisting of a workbench, a lifting platform, a ladder, a belt, a trolley, a carrying handle, and a wall mount.

4. The tool holder system according to claim 1, further comprising attachment means for detachably fastening the extension and retraction device to the tool holder.

5. The tool holder system according to any one of claim 1, 2 or 4, wherein the attachment means is selected from the group consisting of a push-in connection, a screw connection, a hook-and-loop connection and a snap connection.

* * * * *